US009989298B1

(12) United States Patent
Wantland et al.

(10) Patent No.: US 9,989,298 B1
(45) Date of Patent: Jun. 5, 2018

(54) POWERED ADJUSTABLE SHELF FOR REFRIGERATOR APPLIANCE

(71) Applicant: Haier US Appliance Solutions, Inc., Wilmington, DE (US)

(72) Inventors: Louis A. Wantland, Louisville, KY (US); Bagawathkumar Chellappan, Louisville, KY (US); William Jeremy Leachman, Pewee Valley, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days. days.

(21) Appl. No.: 15/422,509

(22) Filed: Feb. 2, 2017

(51) Int. Cl.

| | |
|---|---|
| ***F25D 25/02*** | (2006.01) |
| ***A47B 57/42*** | (2006.01) |
| ***F25D 27/00*** | (2006.01) |
| ***F25D 11/00*** | (2006.01) |

(52) U.S. Cl.
CPC ..... *F25D 25/02* (2013.01); *A47B 57/42* (2013.01); *F25D 11/00* (2013.01); *F25D 27/00* (2013.01)

(58) Field of Classification Search
CPC ..... A47B 57/42; A47B 57/425; A47B 57/45; A47B 57/56; A47B 57/562; F25D 27/00; F25D 27/005; F25D 2327/00; F25D 2400/40; F25D 25/02
See application file for complete search history.

(56) References Cited

U.S. PATENT DOCUMENTS

| | | | | |
|---|---|---|---|---|
| 3,506,325 | A * | 4/1970 | Horvay | F25D 25/02 312/223.5 |
| 5,695,261 | A * | 12/1997 | Slesinger | A47F 11/10 312/223.6 |
| 6,813,896 | B1 | 11/2004 | Janke et al. | |
| 8,235,539 | B2 | 8/2012 | Thomas et al. | |
| 9,157,678 | B2 | 10/2015 | Kerner | |
| 9,455,506 | B2 * | 9/2016 | Kerner | H01R 43/00 |
| 2008/0043456 | A1 * | 2/2008 | Bernardini | A47B 57/42 362/94 |
| 2014/0217879 | A1 * | 8/2014 | Kerner | F25D 27/005 312/408 |
| 2014/0349502 | A1 * | 11/2014 | Meis | A47B 97/00 439/212 |
| 2015/0255193 | A1 * | 9/2015 | Hammond | F21V 33/0044 362/92 |
| 2016/0341470 | A1 * | 11/2016 | Brown | F25D 27/00 |

FOREIGN PATENT DOCUMENTS

| | | | | |
|---|---|---|---|---|
| DE | 3439657 | A1 * | 4/1986 | A47B 57/42 |

* cited by examiner

*Primary Examiner* — Andrew M Roersma
(74) *Attorney, Agent, or Firm* — Dority & Manning, P.A.

(57) ABSTRACT

A refrigerator appliance includes a cabinet and a powered track disposed within the cabinet for receiving adjustable shelves at various shelf mounting positions. The powered track can include a first and a second power bus in electrical communication with a power source. The adjustable shelf can include a first electrical connector and a second electrical connector that are biased in electrical communication with the first and second power bus, respectively, when the adjustable shelf is mounted to the powered track.

19 Claims, 12 Drawing Sheets

POWERED ADJUSTABLE SHELF FOR REFRIGERATOR APPLIANCE

FIELD OF THE INVENTION

The present disclosure is related generally to refrigerator appliances, and more particularly to refrigerator appliances that include powered tracks for delivering power to adjustable shelves.

BACKGROUND OF THE INVENTION

Certain conventional refrigerator appliances include adjustable shelves that can be moved from one shelf mounting position to another within the refrigerator appliance. In some instances, adjustable shelves are mounted to powered tracks so that power can be provided to the shelves for shelf lighting, temperature control, and/or other desirable features. Powered tracks are generally configured to provide power to adjustable shelves no matter their mounting position within the refrigerator appliance. In this way, the configuration of shelves within the refrigerator can be arranged to suit the needs of a user without loss of powered functionality.

Despite the benefits of powered tracks, they generally require more time to assemble and include more parts than non-powered tracks. Conventional refrigerator appliances with powered tracks generally include two or more powered tracks. Thus, the production time and costs to build these types of refrigerator appliances is increased. Moreover, conventional powered tracks generally do not offer robust or reliable electrical connections with adjustable shelves mounted thereto. Accordingly, the power delivered to the shelves may be disrupted, causing inconvenience to the user.

In addition, load-carrying members of conventional powered tracks and/or adjustable shelves sometimes double as current-carrying electrical components. Where load-bearing members double as an electrical component, the selected material needs to be both structurally capable of supporting a given weight and generally needs corrosion protection for safety purposes and for maintaining conductive properties of the component. This effectively limits material selection for the shelf and/or powered track components, as corrosion resistant materials need be selected and/or protective coatings need be applied to protect the components.

Accordingly, improved refrigerator appliances that address one or more of the above challenges are desirable.

BRIEF DESCRIPTION OF THE INVENTION

The present invention provides a refrigerator appliance that includes a powered track for delivering power to an adjustable shelf. In a general aspect, exemplary powered track provides a plurality of shelf mounting positions for receiving one or more adjustable shelves. The powered track may include a first and second power bus in electrical communication with a power source. The adjustable shelf can include a first electrical connector and a second electrical connector that are biased in electrical communication with the first and second power bus, respectively, when the adjustable shelf is mounted to the powered track. Thus, power is provided to one or more loads of the adjustable shelf. Additional aspects and advantages of the invention will be set forth in part in the following description, or may be apparent from the description, or may be learned through practice of the invention.

In accordance with one embodiment, a refrigerator appliance is disclosed. The refrigerator appliance includes a cabinet defining a volume and a powered track disposed within the cabinet for providing a plurality of shelf mounting positions and configured in electrical communication with a power source. The powered track includes a first support member defining a plurality of openings. A first bus bar is coupled with the first support member and defines a plurality of openings each in alignment with a corresponding opening of the first support member. A second support member is coupled with the first support member. A second bus bar is spaced from the first bus bar and is coupled with the second support member. The refrigerator appliance further includes an adjustable shelf having at least one bracket attached to or formed integrally with the adjustable shelf for mounting the adjustable shelf to the powered track in one of the shelf mounting positions. The at least one bracket includes a body extending between a first end and a second end. The bracket also includes a first tab extending from the second end of the body and having a first electrical connector. When the adjustable shelf is mounted to the powered track at one of the shelf mounting positions, the first electrical connector is in electrical communication with the first bus bar. The bracket also includes a second tab extending from the second end of the body and having a second electrical connector. When the adjustable shelf is mounted to the powered track at one of the shelf mounting positions, the second electrical connector is in electrical communication with the second bus bar.

In one exemplary aspect, the first tab of the bracket of the adjustable shelf optionally includes a hook for securing the adjustable shelf to the powered track. The first electrical connector is positioned on the hook.

In another exemplary aspect, optionally, the cabinet of the refrigerator appliance defines a vertical direction and the hook includes a vertical face oriented substantially along the vertical direction. The first electrical connector is positioned on the vertical face of the hook such that when the adjustable shelf is mounted to the powered track, the first electrical connector is biased against the first bus bar.

In yet another exemplary aspect, optionally, the powered track defines one or more mounting openings for receiving the adjustable shelf. The first support member includes a forward surface and the second bus bar includes a forward surface. Moreover, a depth of at least one of the mounting openings extends between the forward surface of the first support member and the forward surface of the second bus bar. When the adjustable shelf is mounted to the powered track, the bracket extends into the at least one mounting opening a distance greater than the depth in such a way that the second electrical contact deflects the second bus bar, biasing the second bus bar against the second electrical contact.

In accordance with another exemplary embodiment, a refrigerator appliance is disclosed. The refrigerator appliance defines a vertical direction, a horizontal direction, and a transverse direction. The refrigerator appliance includes a cabinet defining a volume and a powered track disposed within the cabinet and configured to be in electrical communication with a power source. The powered track includes a first support member defining a plurality of openings and a first bus bar coupled with the first support member and defining a plurality of openings each in alignment with a corresponding opening of the first support member. The powered track also includes a second bus bar spaced from the first bus bar. The refrigerator appliance also includes an adjustable shelf that extends between a first end and a second end, the second end having a first electrical connector and a second electrical connector located thereon or integral with the second end. When the adjustable shelf is mounted to the powered track, the first electrical connector is in electrical communication with the first bus bar and the second electrical connector is in electrical communication with the second bus bar.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
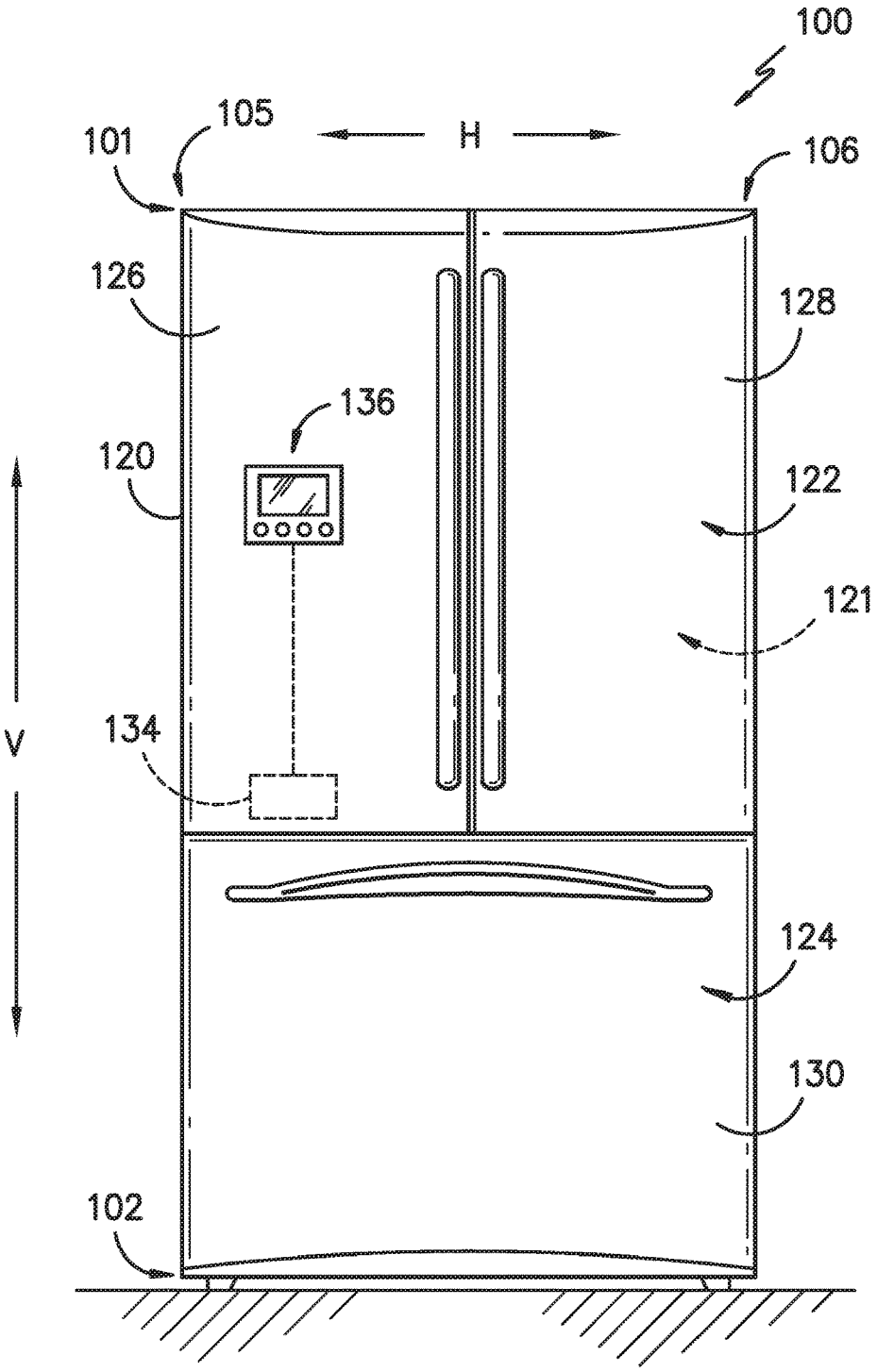
FIG. 1 provides a front view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front view of a refrigerator appliance 100 according to an exemplary embodiment of the present subject matter. Refrigerator appliance 100 extends between a top 101 and a bottom 102 along a vertical direction V. Refrigerator appliance 100 also extends between a first side 105 and a second side 106 along a horizontal direction H. A transverse direction T (FIG. 2) is defined perpendicular to the vertical and horizontal directions V, H. Accordingly, vertical direction V, horizontal direction H, and transverse direction T are mutually perpendicular and form an orthogonal direction system.

Refrigerator appliance 100 includes a housing or cabinet 120 defining a volume 121. Cabinet 120 also defines an upper fresh food chamber 122 and a lower freezer chamber 124 arranged below the fresh food chamber 122 on the vertical direction V. As such, refrigerator appliance 100 is generally referred to as a bottom mount refrigerator. In this exemplary embodiment, cabinet 120 also defines a mechanical compartment (not shown) for receipt of a sealed cooling system (not shown). It will be appreciated that the present subject matter can be used with other types of refrigerators (e.g., side-by-sides), freezer appliances, and/or other types of appliances more generally. Consequently, the description set forth herein is for exemplary purposes only and is not intended to limit the scope of the present subject matter in any aspect.

Refrigerator appliance 100 includes refrigerator doors 126, 128 that are rotatably hinged to an edge of cabinet 120 for accessing fresh food chamber 122. It should be noted that while doors 126, 128 are depicted in a "french door" configuration, any suitable arrangement or number of doors is within the scope and spirit of the present subject matter. A freezer door 130 is arranged below refrigerator doors 126, 128 for accessing freezer chamber 124.

Operation of refrigerator appliance 100 can be regulated by a controller 134 that is operatively coupled to a user interface panel 136. Panel 136 provides selections for user manipulation of the operation of refrigerator appliance 100 such as e.g., interior shelf lighting settings. In response to user manipulation of user interface panel 136, controller 134 operates various components of refrigerator appliance 100. Controller 134 may include a memory and one or more processors, microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

Controller 134 may be positioned in a variety of locations throughout refrigerator appliance 100. In the illustrated embodiment, controller 134 is located within door 126. In such an embodiment, input/output ("I/O") signals may be routed between the controller and various operational components of refrigerator appliance 100. In one embodiment, user interface panel 136 may represent a general purpose I/O ("GPIO") device or functional block. The user interface 136 may include input components, such as one or more of a variety of electrical, mechanical or electro-mechanical input devices including rotary dials, push buttons, and touch pads. User interface 136 may include a display component, such as a digital or analog display device designed to provide operational feedback to a user. The user interface 136 may be in communication with controller 134 via one or more signal lines or shared communication busses.

Figure 2:
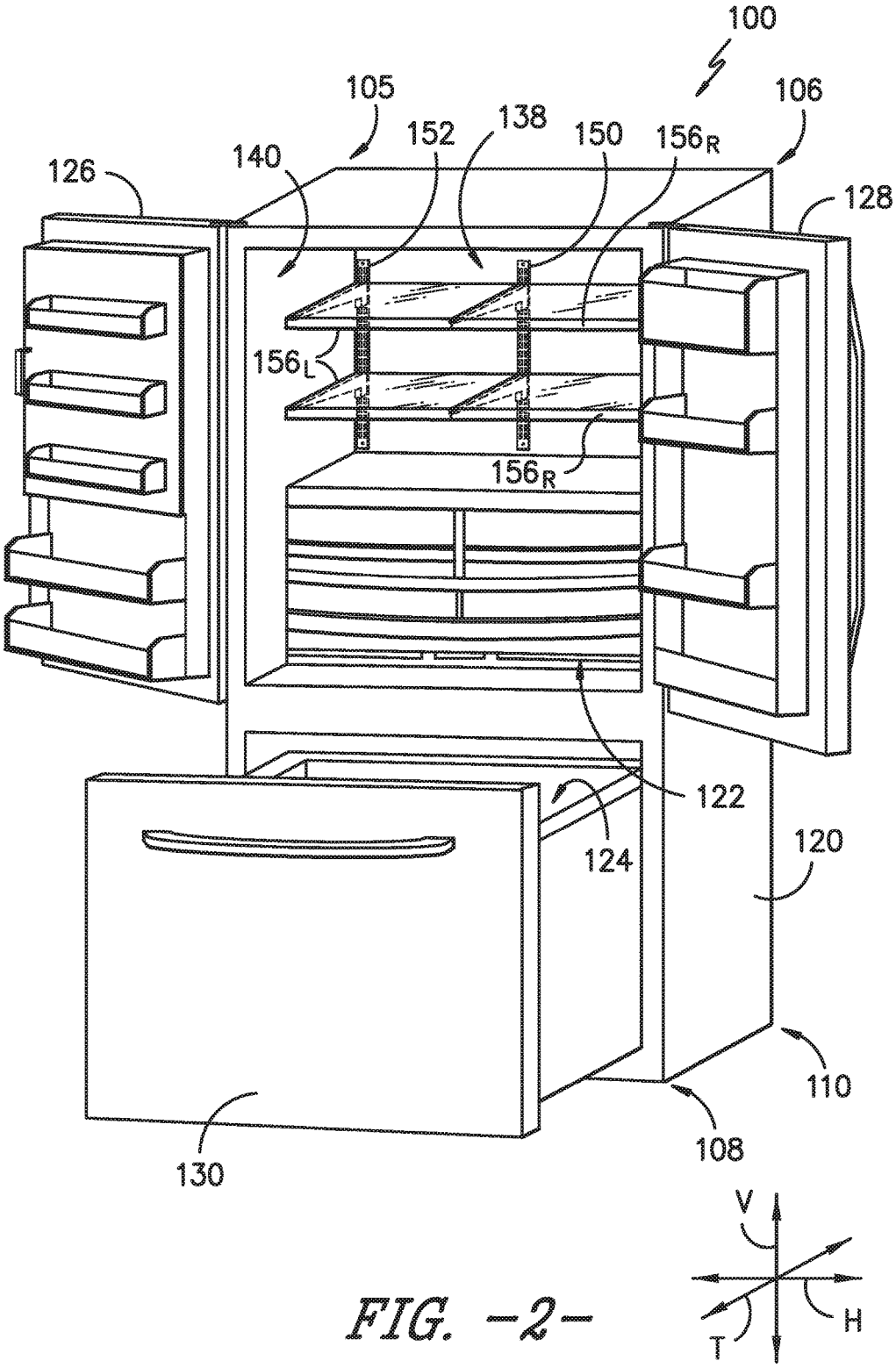
FIG. 2 provides a front perspective view of the refrigerator appliance of FIG. 1 with refrigerator doors and a freezer door shown in an open configuration to reveal a fresh food chamber and freezer chamber of the refrigerator appliance according to an exemplary embodiment of the present subject matter.

FIG. 2 provides a front, perspective view of refrigerator appliance 100 having refrigerator doors 126, 128 in an open position to reveal the interior of fresh food chamber 122. Additionally, freezer door 130 is shown in an open position to reveal the interior of freezer chamber 124. As shown more clearly in FIG. 2, refrigerator appliance 100 extends in the transverse direction T between a front end 108 and a rear end 110.

Figure 3:
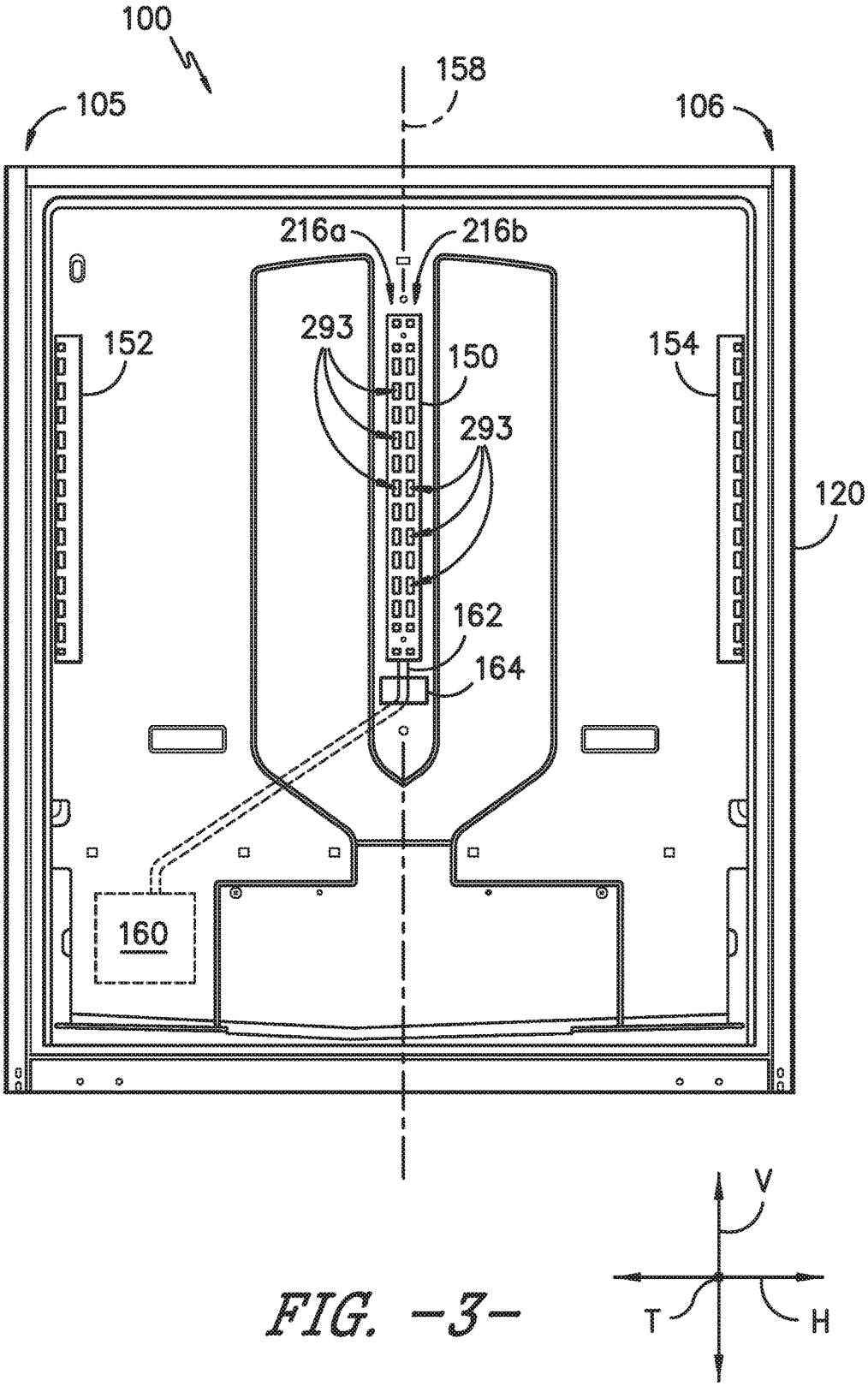
FIG. 3 provides a front view of a cabinet of the refrigerator appliance of FIG. 1 according to an exemplary embodiment of the present subject matter.

As shown in FIGS. 2 and 3, for this exemplary embodiment, fresh food chamber 122 of refrigerator appliance 100 includes a powered track 150 and two non-powered tracks 152, 154 mounted to a rear wall 138 of cabinet 120. Non-powered tracks 152, 154 are oriented generally along the vertical direction V and proximate the first and second sides 105, 106 of refrigerator appliance 100 (the non-powered track 154 positioned proximate the second side 106 of refrigerator appliance 100 is not visible in FIG. 2). Powered track 150 is oriented along the vertical direction V and positioned between the non-powered tracks 152, 154 as shown. In alternative embodiments, powered track 150, non-powered tracks 152, 154 or both could be mounted to another surface within the interior of cabinet 120, such as to one of the sidewalls 140 of cabinet 120 or in the freezer chamber 124. In addition, in some embodiments, refrigerator appliance 100 need not include non-powered tracks 152, 154.

One or more adjustable shelves 156 are mounted to powered track 150 and non-powered tracks 152, 154. In this embodiment, four (4) adjustable shelves 156 are mounted within fresh food chamber 122 and are arranged in two columns and two rows as shown. For the column of adjustable shelves $\mathbf{156}_L$ mounted proximate first side 105 of refrigerator appliance 100, adjustable shelves $\mathbf{156}_L$ are mounted to non-powered track 152 at their sides proximate first side 105 and to powered track 150 at their other sides. For the column of adjustable shelves $\mathbf{156}_R$ mounted proximate second side 106 of refrigerator appliance 100, adjustable shelves $\mathbf{156}_R$ are mounted to non-powered track 154 at their ends proximate second side 106 and to powered track 150 at their other ends. Powered track 150 can provide power to one or more electrical loads positioned on or integral with one of the adjustable shelves 156. For example, powered track 150 can deliver power to LEDs positioned on one or more of the adjustable shelves 156 for lighting the interior of fresh food chamber 122 when one of the doors 126, 128 are in the open position.

Adjustable shelves 156 may be selectively positioned by a user in different shelf mounting positions within fresh food chamber 122. For instance, one adjustable shelf $\mathbf{156}_L$ could be removed from its position and moved vertically upward or downward along the vertical direction V or moved from a position proximate first side 105 to a position proximate second side 106 of refrigerator appliance 100 along the horizontal direction H. Adjustable shelves 156 can also be removed from refrigerator appliance 100. For example, if storage room is needed for a particularly tall pot, adjustable shelves 156 can be removed from refrigerator appliance 100 and stowed elsewhere. Although four (4) adjustable shelves 156 are depicted in FIG. 2, more or less than four (4) adjustable shelves 156 can be provided in refrigerator appliance 100.

FIG. 3 provides a front view of cabinet 120 of refrigerator appliance 100 according to an exemplary embodiment of the present subject matter. In FIG. 3, various components of refrigerator appliance 100 have been omitted for clarity. Cabinet 120 defines a vertical centerline 158 dividing refrigerator appliance 100 along the horizontal direction H. As shown, vertical centerline 158 is oriented midway between first side 105 and second side 106 of refrigerator appliance 100. For this embodiment, powered track 150 is oriented substantially along vertical centerline 158. Non-powered tracks 152, 154 are positioned proximate first side 105 and proximate second side 106 along the vertical direction V as shown. In this manner, one column of adjustable shelves 156 can be mounted proximate the first side 105 of refrigerator appliance 100 and one column of adjustable shelves 156 can be mounted proximate second side 106 of refrigerator appliance 100 (FIG. 2), as powered track 150 provides two columns of possible shelf mounting positions for adjustable shelves 156. More specifically, powered track 150 defines a plurality of mounting openings 293 oriented in a first column **216*a* and a second column 216*b* for providing the shelf mounting positions. In the embodiment of FIG. 3, powered track 150 is configured to power all shelves 156 mounted within refrigerator appliance 100**. Other suitable configurations may be used as well.

As shown in FIG. 3, powered track 150 is in electrical communication with a power source 160. For this embodiment, power source 160 is a power supply isolated from the line voltage supplying power to the main loads of refrigerator appliance 100, such as the compressor, motors, etc. Power source 160 could be a 12 volt or 24 volt power supply for example. Electrical wiring 162 extends from power source 160 to powered track 150. Harness junction 164 provides a conduit for electrical wiring 162 to extend from power source 160 to powered track 150. Although electrical wiring 162 is shown in this embodiment, it will be appreciated that any suitable method for delivering power from power source 160 to powered track 150 is contemplated. For example, powered track 150 can be electrically connected to power source 160 as noted above, e.g., via physical electrical wiring 162. Additionally, or alternatively, powered track 150 can be in electrical communication with power source 160 wirelessly, e.g., via one or more transceiving, transmitting, receiving components, etc.

Figure 4:
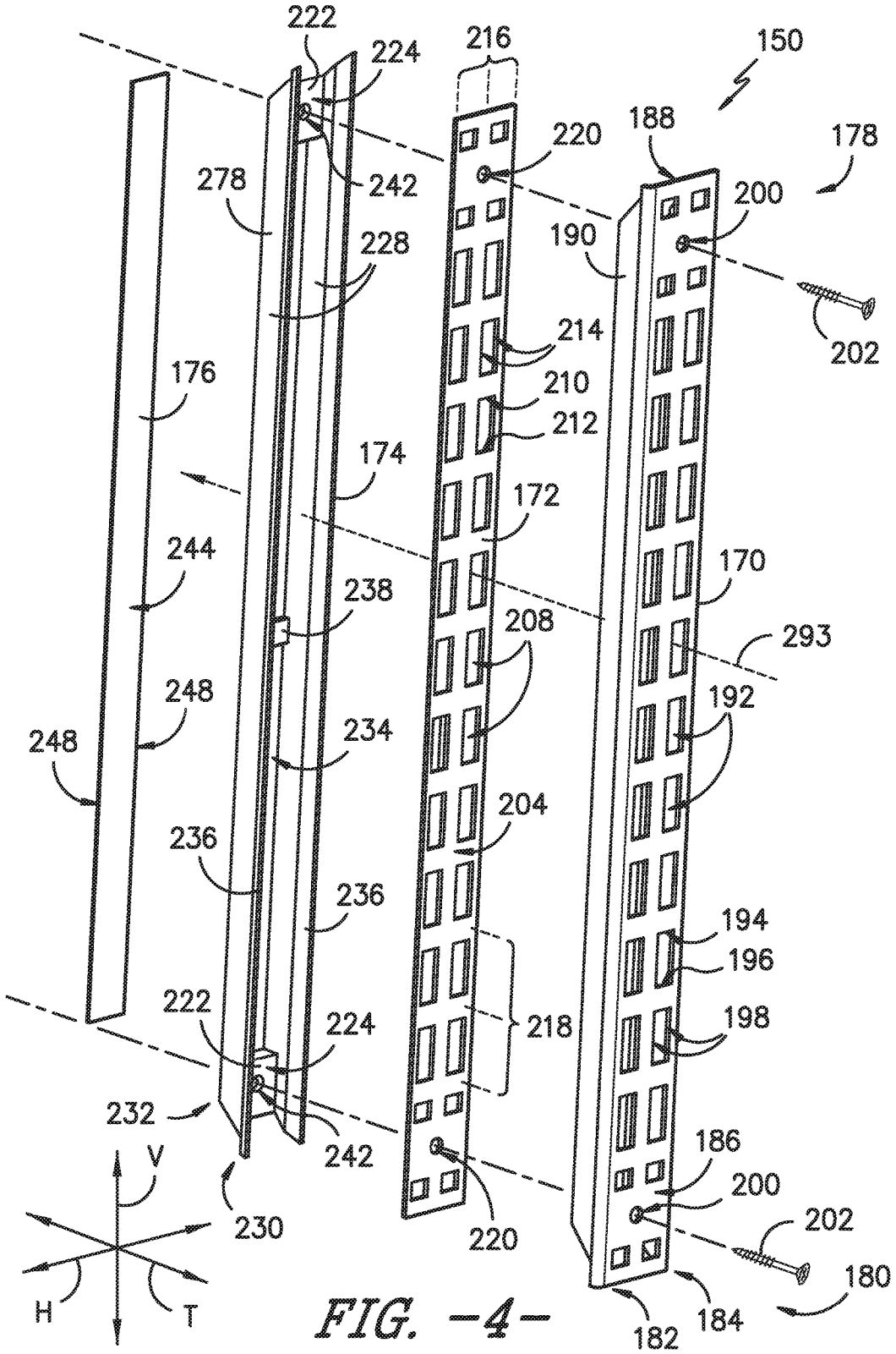
FIG. 4 provides an exploded view of a powered track according to an exemplary embodiment of the present subject matter.

FIG. 4 provides an exploded view of powered track 150 according to an exemplary embodiment of the present subject matter. As shown, from front end 108 to rear end 110 along transverse direction T, powered track 150 includes a first support member 170, a first bus bar 172, a second support member 174, and a second bus bar 176.

First support member 170 structurally supports one or more adjustable shelves 156 when they are mounted to powered track 150. Moreover, first support member 170 structurally supports the weight of the other components of powered track 150. First support member 170 can be made of any suitable structural material. For example, in this embodiment, first support member is made of steel.

First support member 170 extends in the vertical direction V between a top portion 178 and a bottom portion 180 of powered track 150. First support member 170 also extends in the horizontal direction H between a first side portion 182 and a second side portion 184 of powered track 150. First support member 170 includes a front surface 186 and a rear surface 188 (FIG. 10), both of which are substantially coplanar with a plane including both the vertical direction V and the horizontal direction H. Sidewalls 190 extend generally in the transverse direction T from rear surface 188 in a rearward direction. One sidewall 190 extends in the transverse direction T from the first side portion 182 of rear surface 188 and one sidewall 190 (not visible in FIG. 4) extends in the transverse direction T from second side portion 184 of rear surface 188. As depicted, a portion of each sidewall 190 may be angled with respect to the transverse direction T. In this embodiment, the sidewalls 190 of first support member 170 are angled inward toward one another as they extend generally rearward along the transverse direction T. In alternative exemplary embodiments, sidewalls 190 can extend substantially along the transverse direction T from rear surface 188 from their respective first and second side portions 182, 184.

First support member 170 defines a plurality of openings 192 extending between front surface 186 and rear surface 188. Each opening 192 is shown in a generally rectangular configuration, however, other suitable configurations are contemplated, such as square configurations. Each opening 192 includes a top edge 194, a bottom edge 196, and two side edges 198 oriented parallel to one another and perpendicular to the top and bottom edges 194, 196. Openings 192 form a part of mounting openings 293.

First support member also defines one or more apertures 200 extending between front surface 186 and rear surface 188. Apertures 200 receive mechanical fasteners 202, such as screws, for securing powered track 150 with cabinet 120 of refrigerator appliance 100. As shown, one aperture 200 is located proximate top portion 178 of powered track 150 and one aperture 200 is located proximate bottom portion 180. Apertures 200 can be any suitable shape or configuration. For this embodiment, apertures 200 are shown in a generally circular configuration.

First bus bar 172 is an electrically conductive component and is in electrical communication with power source 160 for delivering power to one or more adjustable shelves 156. First bus bar 172 can be any suitable electrically conducting material, such as stainless steel, for example. First bus bar 172 extends in the vertical direction V between top portion 178 and bottom portion 180 of powered track 150. First bus bar 172 also extends in the horizontal direction H between first side portion 182 and second side portion 184. First bus bar 172 includes a front surface 204 and a rear surface 206 (FIG. 10), both of which are substantially coplanar with a plane including both vertical direction V and horizontal direction H. When coupled, front surface 204 of first bus bar 172 sits flush against rear surface 188 of first support member 170. In some exemplary embodiments, however, front surface 204 of first bus bar 172 need not sit flush with rear surface 188 of first support member 170 (i.e., first bus bar 172 may be spaced from first support member 170 along the transverse direction T).

Like first support member 170, first bus bar 172 defines a plurality of openings 208 extending between front surface 204 and rear surface 206. Each opening 208 of first bus bar 172 is shown in a generally rectangular configuration, however, other suitable configurations are contemplated. Each opening 208 includes a top edge 210, a bottom edge 212, and two side edges 214 oriented parallel to one another and perpendicular to top and bottom edges 210, 212. When powered track 150 is assembled, each opening 208 of first bus bar 172 is in alignment with a corresponding opening 192 of first support member 170. Openings 192, 208 of first support member 170 and first bus bar 172 are each configured to receive at least a portion of an adjustable shelf 156 when adjustable shelf 156 is mounted to powered track 150. In this way, like openings 192 of first support member 170, openings 208 form a part of mounting openings 293 shown in FIG. 3.

Openings 192, 208 are organized in columns 216 and rows 218 as shown with respect to first bus bar 172. Columns 216 extend along the vertical direction V and rows 218 extend along the horizontal direction H. Each opening 192, 208 or a combination of openings provides one or more shelf mounting positions in which adjustable shelves 156 can be mounted to powered track 150. Where powered track 150 includes at least two columns, powered track 150 can power at least two columns of adjustable shelves 156, as shown in FIG. 2.

In addition, like first support member 170, first bus bar 172 defines one or more apertures 220 extending between front surface 204 and rear surface 206 of first bus bar 172. As shown, one aperture 220 is located proximate top portion 178 of powered track 150 and one aperture 220 is located proximate bottom portion 180. When powered track 150 is assembled, each aperture 220 of first bus bar 172 is in alignment with a corresponding aperture 200 of first support member 170. In this regard, apertures 200, 220 of first support member 170 and first bus bar 172 receive mechanical fasteners 202 for securing powered track 150 with cabinet 120 of refrigerator appliance 100.

Referring still to FIG. 4, second support member 174 extends in the vertical direction V between top portion 178 and bottom portion 180 of powered track 150. Second support member 174 also extends in the horizontal direction H between first side portion 182 and second side portion 184. Second support member 174 can be made of any suitable material, such as plastic. Preferably, second support member 174 is a non-conductive material.

Second support member 174 includes horizontal members 222, one of which is located proximate top portion 178 and one is located proximate bottom portion 180 of powered track 150. Horizontal members 222 both include a front surface 224 and a rear surface 226 (FIG. 10), both of which are substantially planar with the horizontal direction H. Horizontal members 222 extend in the horizontal direction H between opposed transverse members 228. Each transverse member 228 extends in the transverse direction T between a front portion 230 and a rear portion 232 of second support member 174 and each transverse member 228 extends in the vertical direction V between top portion 178 and bottom portion 180 of powered track 150. Horizontal members 222 and transverse members 228 define a gap 234. Gap 234, along with openings 192, 208 of first support member 170 and first bus bar 172, form a part of mounting openings 293. As shown by the dashed line denoted with 293 in FIG. 4, adjustable shelves 156 or portions thereof can be inserted through openings 192, 208 and into gap 234 (collectively "mounting openings 293") to secure adjustable shelf 156 to powered track 150.

Extending from front portion 230 of each transverse member 228 are sidewalls 236. Sidewalls 236 extend substantially in the transverse direction T from transverse members 228 in a forward direction toward first support member 170. As depicted, sidewalls 236 may be angled with respect to the transverse direction T. In this embodiment, sidewalls 236 of second support member 174 are angled outward with respect to one another as they extend generally forward along the transverse direction T. When powered track 150 is assembled, sidewalls 236 of second support member 174 mate with sidewalls 190 of first support member 170. In this regard, the angled sidewalls 236 of second support member 174 are complementary to sidewalls 190 of first support member 170. In other alternative exemplary embodiments, sidewalls 236 can be configured to extend substantially along the transverse direction T in the forward direction.

Figure 5:
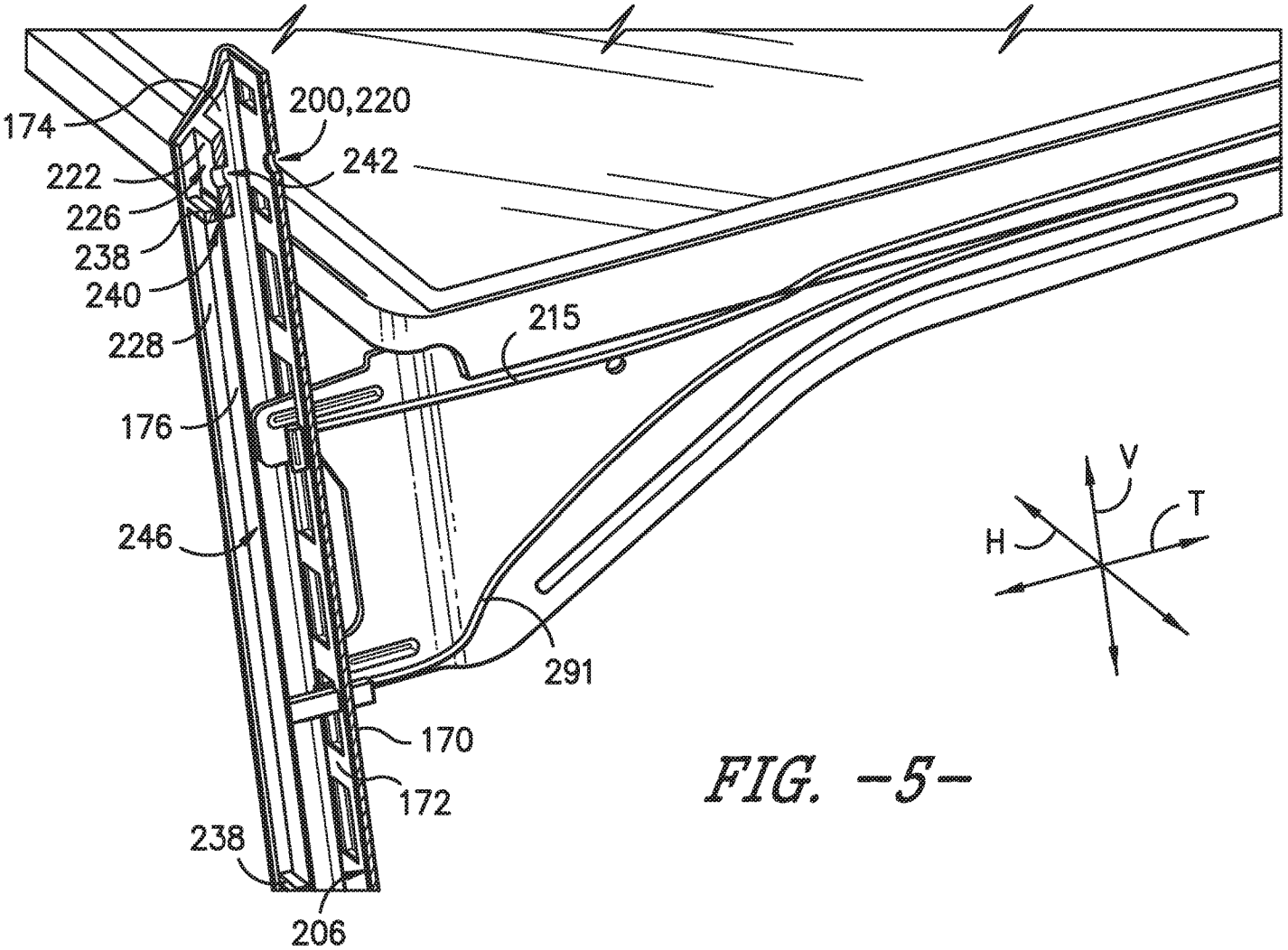
FIG. 5 provides a rear, perspective view of an adjustable shelf mounted to the powered track of FIG. 4 according to an exemplary embodiment of the present subject matter.

With reference now to FIGS. 4 and 5, FIG. 5 provides a perspective, cutaway view of powered track 150 of FIG. 4 with exemplary adjustable shelf 156 mounted thereto according to an exemplary embodiment of the present subject matter. As shown in FIGS. 4 and 5, one or more retention members 238 extend in the horizontal direction H between opposed transverse members 228. With specific reference to FIG. 4, one retention member 238 is shown positioned approximately midway between top portion 178 and bottom portion 180 of powered track 150. And with specific reference to FIG. 5, retention members 238 can also be positioned proximate top portion 178. Although not shown, retention members 238 can be positioned proximate bottom portion 180. Retention members 238 positioned proximate top and bottom portion 178, 180 are spaced from the horizontal members 222 in the transverse direction T. Specifically, retention members 238 are spaced rearward of horizontal members 222 in the transverse direction T. Retention members 238 can be positioned directly behind horizontal members 222. In this way, horizontal members 222 and retention members 238 define slits 240 in which second bus bar 176 is coupled with second support member 174. More particularly, for this embodiment, second bus bar 176 is coupled with second support member 174 by sliding second bus bar 176 into slits 240 of second support member 174. For example, second bus bar 176 can be press or friction fit into slits 240. It will be appreciated, however, that second bus bar 176 can be coupled with second support member 174 in any suitable manner. In addition, although not shown, second support member 174 can include channels extending along the vertical direction V on the inner side of the transverse members 228 for receiving side surfaces of second bus bar 176. This may further secure second bus bar 176 in place. In addition, as shown in FIG. 5, second bus bar 176 is spaced apart from first bus bar 172 along the transverse direction T. Specifically, second bus bar 176 is spaced rearward of first bus bar 172 along the transverse direction T.

Referring again to FIG. 4, like first support member 170 and first bus bar 172, second support member 174 defines one or more apertures 242 extending between front surface 224 and rear surface 226 of horizontal members 222 of second support member 174. As shown, one aperture 242 is located proximate top portion 178 of powered track 150 and one aperture 220 is located proximate bottom portion 180. When powered track 150 is assembled, each aperture 242 of second support member 174 is in alignment with corresponding aperture 200 of first support member 170 and corresponding aperture 220 of first bus bar 172. In this way, apertures 200, 220, 242 receive mechanical fasteners 202 for securing powered track 150 with cabinet 120 of refrigerator appliance 100.

Second bus bar 176, like first bus bar 172, is an electrically conductive component and is in electrical communication with power source 160 for delivering power to one or more adjustable shelves 156. Second bus bar 176 can be any suitable conducting material, such as stainless steel. Second bus bar 176 extends in the vertical direction V between top portion 178 and bottom portion 180 of powered track 150. Second bus bar 176 also extends in the horizontal direction H between first side portion 182 and second side portion 184. Second bus bar 176 includes a front surface 244 and a rear surface 246 (FIG. 10), both of which are substantially planar with the horizontal direction H, and two side surfaces 248 that are substantially planar with the transverse direction T and connect front and rear surfaces 244, 246 of second bus bar 176. As noted above, second bus bar 176 is coupled with second support member 174.

Figure 6:
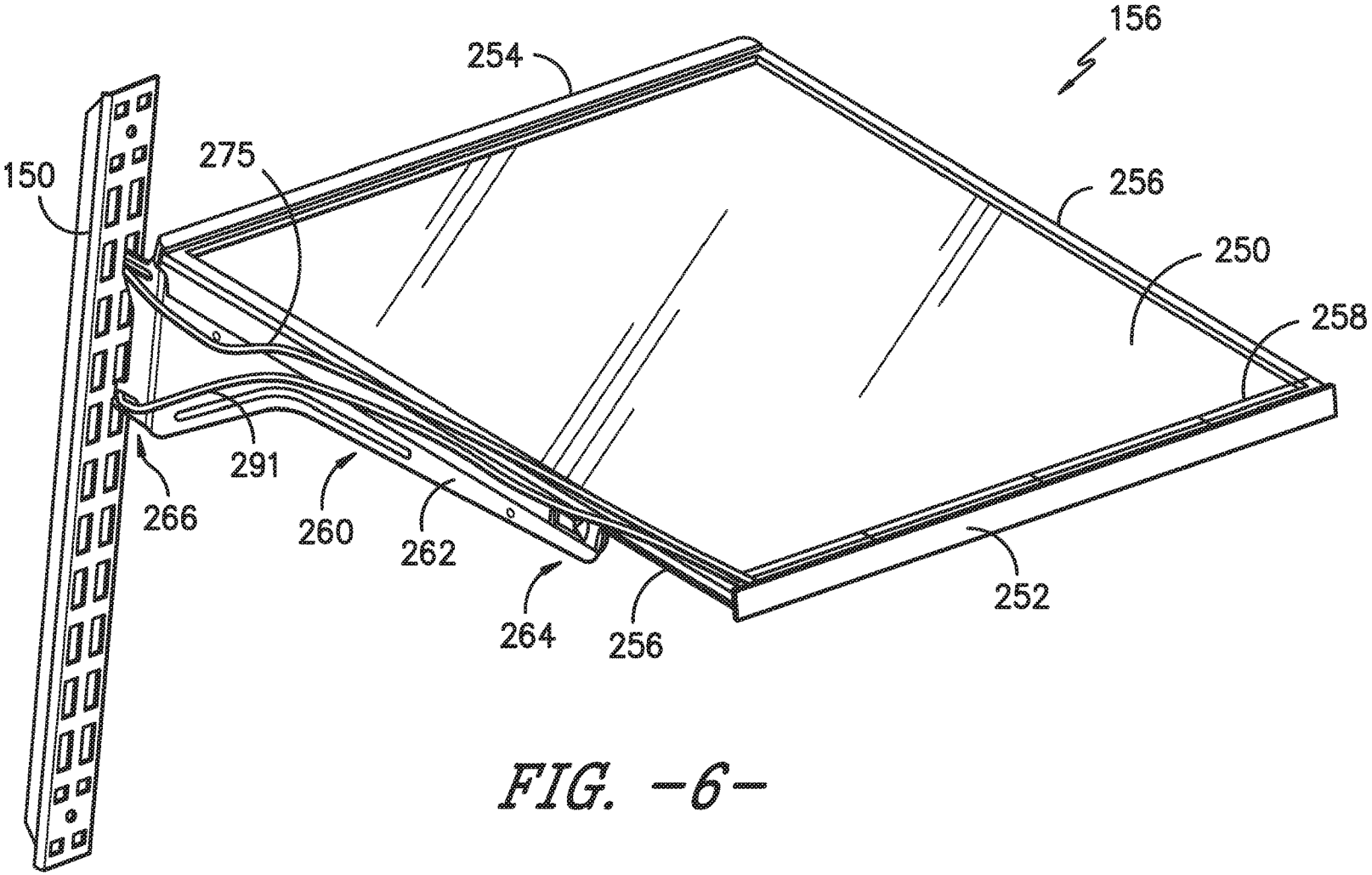
FIG. 6 provides a front, perspective view of an adjustable shelf mounted to a power track according to an exemplary embodiment of the present subject matter.
Figure 7:
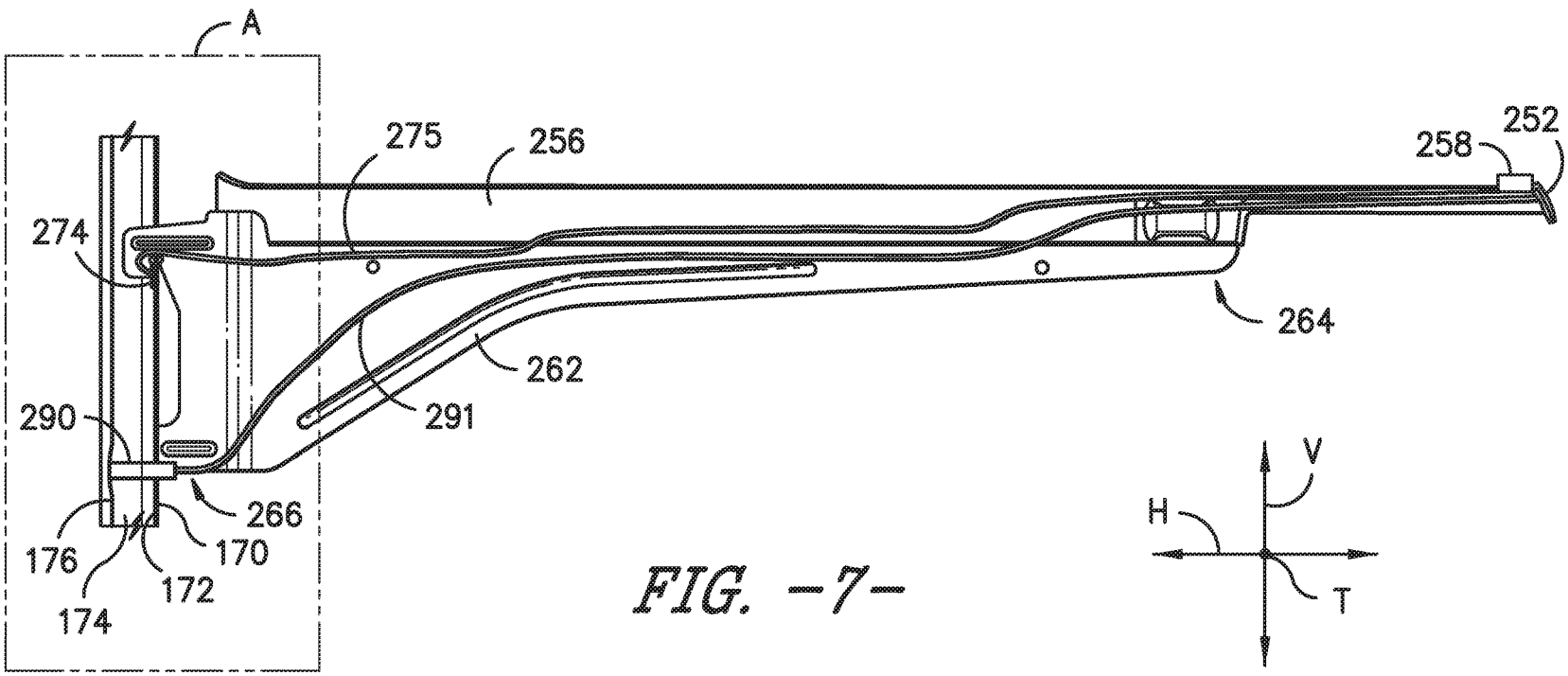
FIG. 7 provides a side view of the adjustable shelf of FIG. 6 mounted to powered track according to an exemplary embodiment of the present subject matter.
Figure 8:
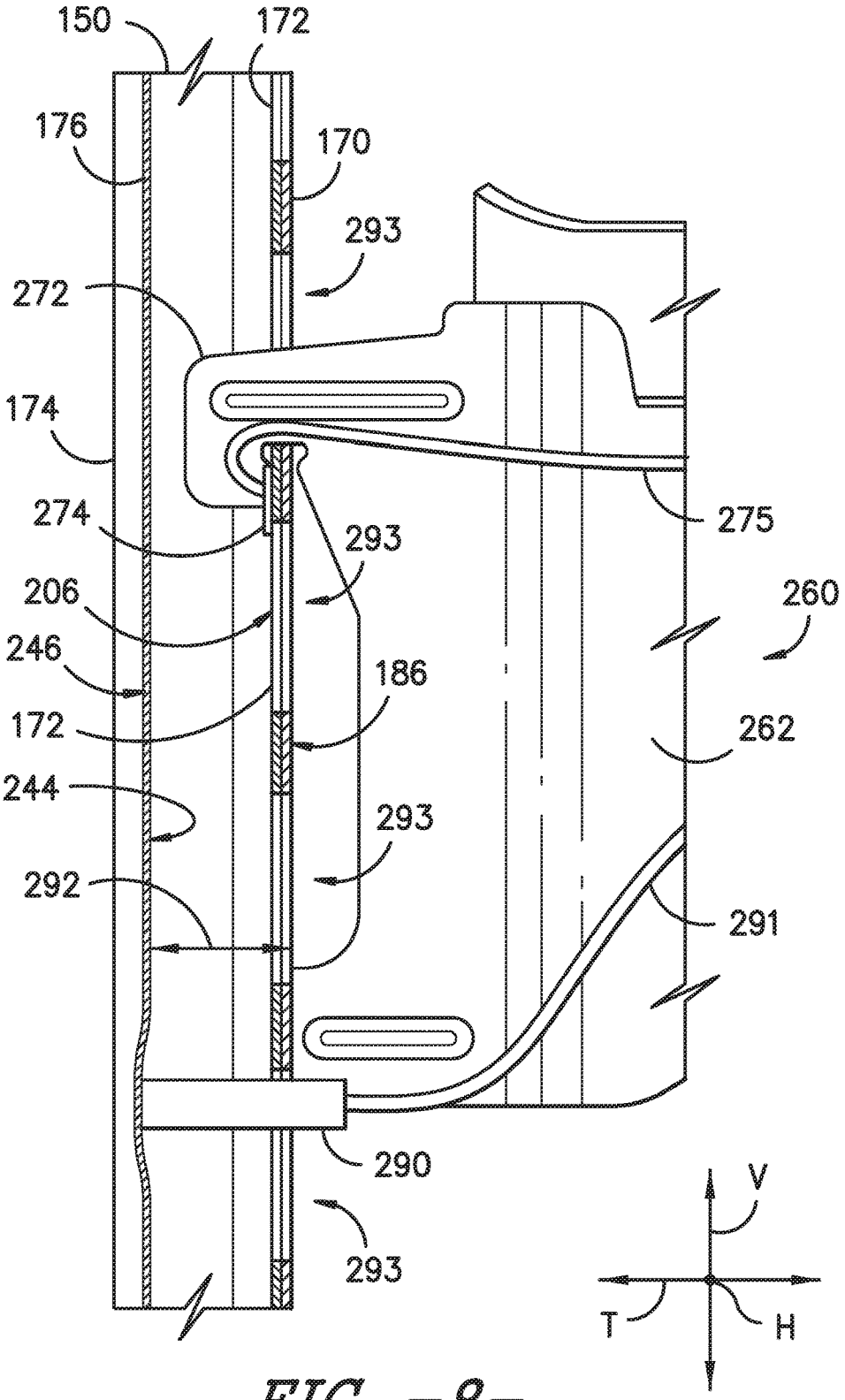
FIG. 8 provides a close-up view of Section A of FIG. 7 detailing the mounting of the adjustable shelf to the powered track according to an exemplary embodiment of the present subject matter.
Figure 9:
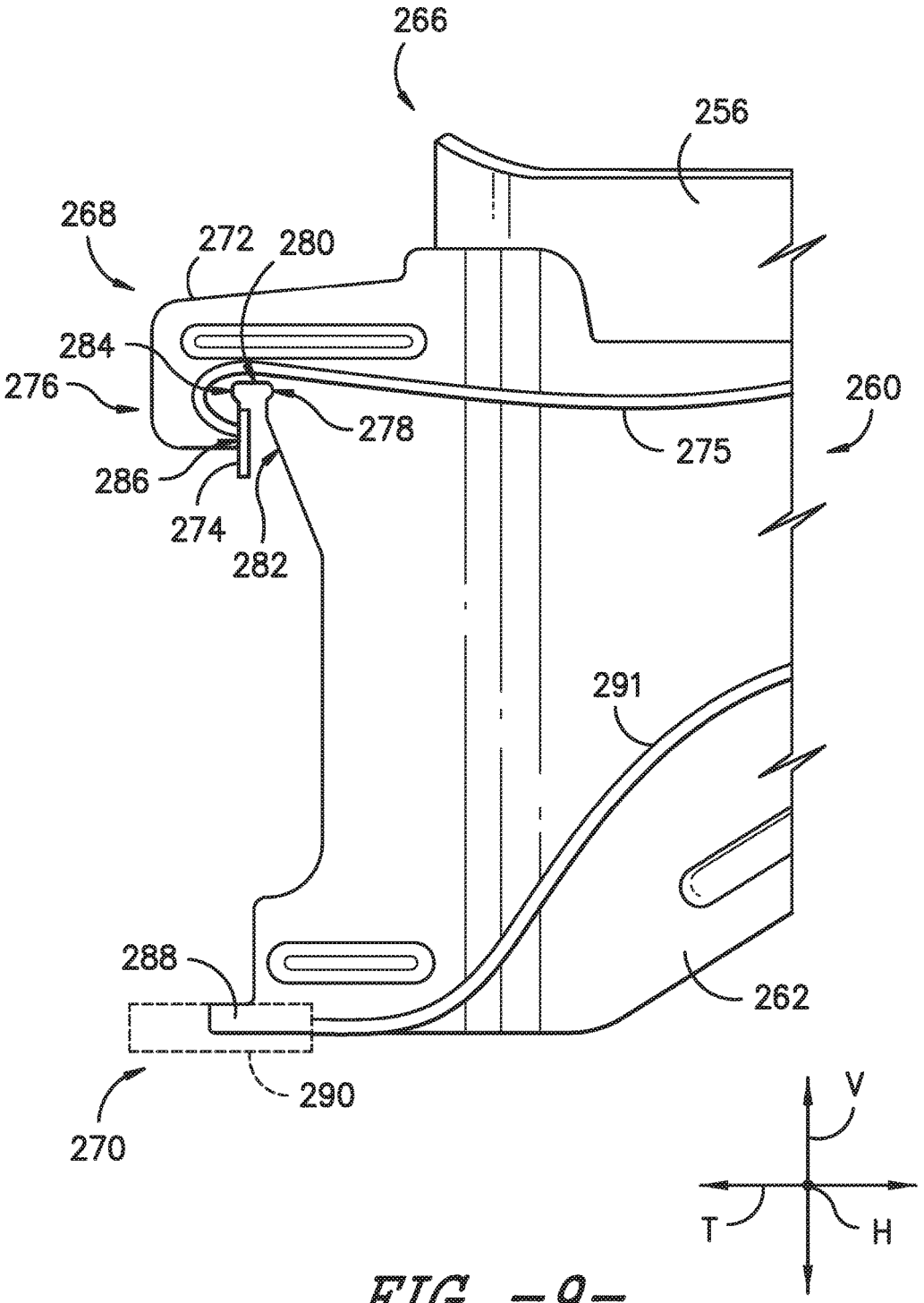
FIG. 9 provides another close-up view of Section A of FIG. 7 with the powered track omitted according to an exemplary embodiment of the present subject matter.

With general reference now to FIGS. 6 through 9, various views of adjustable shelf 156 mounted to powered track 150 are provided according to exemplary embodiments of the present subject matter. In particular, FIG. 6 provides a front perspective view of adjustable shelf 156 mounted to powered track 150; FIG. 7 provides a side view of adjustable shelf 156 of FIG. 6 mounted to powered track 150; FIG. 8 provides a close-up view of Section A of FIG. 7; and FIG. 9 is another view of Section A of FIG. 7 with powered track 150 omitted for clarity.

With specific reference to FIG. 6, adjustable shelf 156 includes a shelf panel 250 having a top surface and a bottom surface. A front member 252, a rear member 254, and a pair of side members 256 are affixed to the edges of shelf panel 250 around its perimeter. Front member 252, rear member 254, both side members 256 or a combination of the foregoing can include a load 258 or powered feature. Load 258 could be LED shelf lighting as shown in FIG. 6, or additionally or alternatively, any other feature, such as temperature controls, microphones, speakers, cameras, sensors such as ethylene sniffers, load cells to weigh milk, fans, thermoelectric cells, and/or other desirable features. Front, rear, and side members 252, 254, 256 can be made of any suitable materials, such as metal or plastic, and shelf panel 250 can be made of any suitable material as well. In this embodiment, shelf panel 256 is a tempered glass.

Adjustable shelf 156 includes at least one bracket 260 attached to or formed integrally with adjustable shelf 156 for mounting adjustable shelf 156 to powered track 150 in one of the shelf mounting positions. For this embodiment, bracket 260 is attached to side member 256. Bracket 260 includes a body 262 that extends between a first end 264 and a second end 266 along the transverse direction T. Bracket 260 extends in the vertical direction V between a top end 268 and a bottom end 270, which is shown more clearly in FIG. 9.

With reference now to FIGS. 8 and 9, bracket 260 includes a first tab 272 extending from second end 266 of body 262. For this embodiment, first tab 272 extends from second end 266 in the transverse direction T and is located proximate top end 268 of bracket 260. First tab 272 includes a first electrical connector 274, which is connected to a first wire 275 that provides for electrical communication between first electrical connector 274 and load 258 of adjustable shelf 156. With the use of first wire 275, bracket 260 need not be an electrically conducting or corrosion-resistant material, as first wire 275 decouples the load bearing and electrical functionality of bracket 260. Although first wire 275 is illustrated as being visible in the figures, it will be appreciated that a casing or housing may hide first wire 275 from view in some exemplary embodiments.

As detailed in FIG. 9, first tab 272 includes a hook 276 for securing adjustable shelf 156 to powered track 150. Hook 276 includes a first curved surface 278 that transitions first tab 272 from a bracket face 282, which may be a generally vertical face as shown, to a support face 280, which extends substantially along transverse direction T and is substantially planar with the transverse and horizontal directions T, H. When adjustable shelf 156 is inserted into one or more of the openings 192, 208 of powered track 150, support face 280 of hook 276 engages bottom edge 196 of opening 192 of first support member 170. In this way, first support member 170 at least partially supports the weight of adjustable shelf 156 when it is mounted to powered track 150.

A second curved surface 284 transitions support face 280 to a vertical face 286. Vertical face 286 is oriented substantially along the vertical direction V and is substantially opposed to bracket face 282. First electrical connector 274 is positioned on the hook 276, and in particular, first electrical connector 274 is positioned on or is integral with the vertical face 286 of hook 276. When hook 276 is inserted into one of the openings 192, 208 of powered track 150, first electrical connector 274 positioned on vertical face 286 engages rear surface 206 of first bus bar 172, as shown in FIG. 8. In this manner, first electrical connector 274 is in electrical communication with first bus bar 172. Moreover, as adjustable shelf 156 is cantilevered from powered track 150 when mounted thereto, first electrical connector 274 is biased in engagement with first bus bar 172 as vertical face 286 tends to compress first electrical connector 274 with rear surface 206 of first bus bar 172, providing a secure mating of the two electrical components.

Referring still to FIGS. 8 and 9, bracket 260 also includes a second tab 288. Second tab 288 extends from second end 266 of body 262. For this embodiment, second tab 288 extends from second end 266 in the transverse direction T and is located proximate bottom end 270 of bracket 260. As shown, a second electrical connector 290 (shown transparent in FIG. 9) is positioned on or integral with second tab 288. Second electrical connector 290 is connected to a second electrical wire 291 that provides for electrical communication between second electrical connector 290 and load 258 of adjustable shelf 156. With the use of second wire 291, bracket 260 need not be an electrically conducting or corrosion-resistant material, as second wire 291 decouples the load bearing and electrical functionality of bracket 260. Although second wire 291 is illustrated as being visible in the figures, it will be appreciated that a casing or housing may hide second wire 291 from view in some exemplary embodiments.

With specific reference to FIG. 8, when adjustable shelf 156 is mounted to powered track 150 at one of the shelf mounting positions, second electrical connector 290 is configured to be in electrical communication with second bus bar 176. Specifically, second electrical connector 290 contacts front surface 244 of second bus bar 176. Forward surface 186 of first support member 170 and forward surface 244 of second bus bar 176 define a depth 292 of a mounting opening 293. Stated alternatively, depth 292 of mounting opening 293 extends between forward surface 186 of first support member 170 and forward surface 244 of second bus bar 176. When adjustable shelf 156 is mounted to powered track 150, bracket 260 and its second electrical connector 290 extend a distance greater than the depth 292 of mounting opening 293 in such a way that second electrical connector 290 deflects second bus bar 176, biasing second bus bar 176 against second electrical connector 290. Biasing second bus bar 176 against second electrical connector 290 provides a secure mating of the two electrical components. The deflection of second bus bar 176 caused by second electrical connector 290 is exaggerated in FIG. 8 for illustrative purposes.

Figure 10:
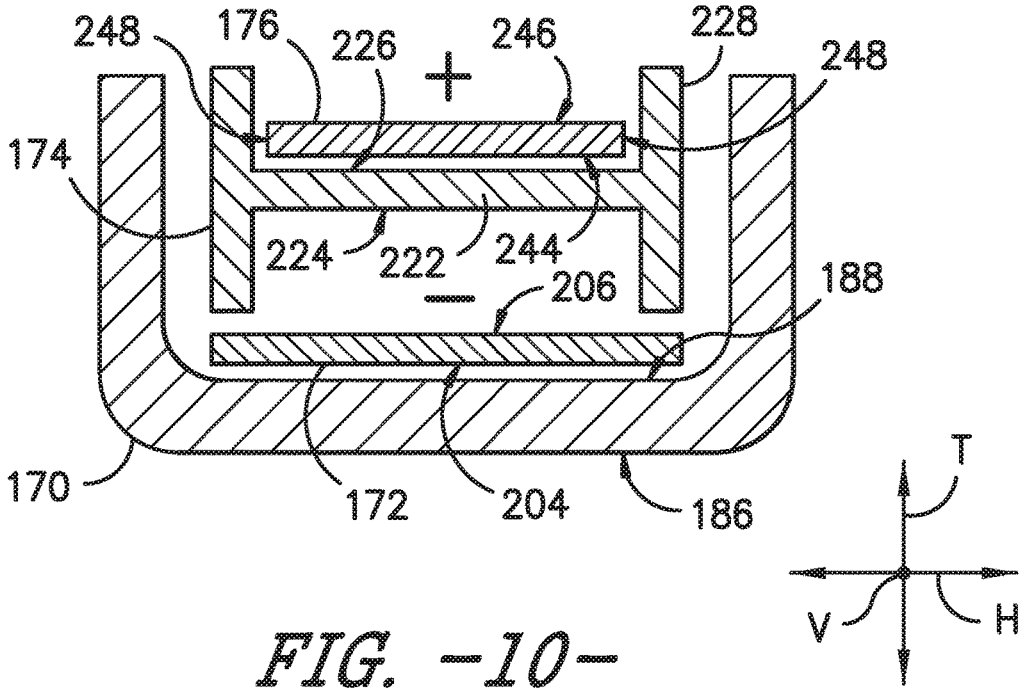
FIG. 10 provides a top plan view of a powered track for use with a constant voltage circuit according to an exemplary embodiment of the present subject matter.
Figure 11:
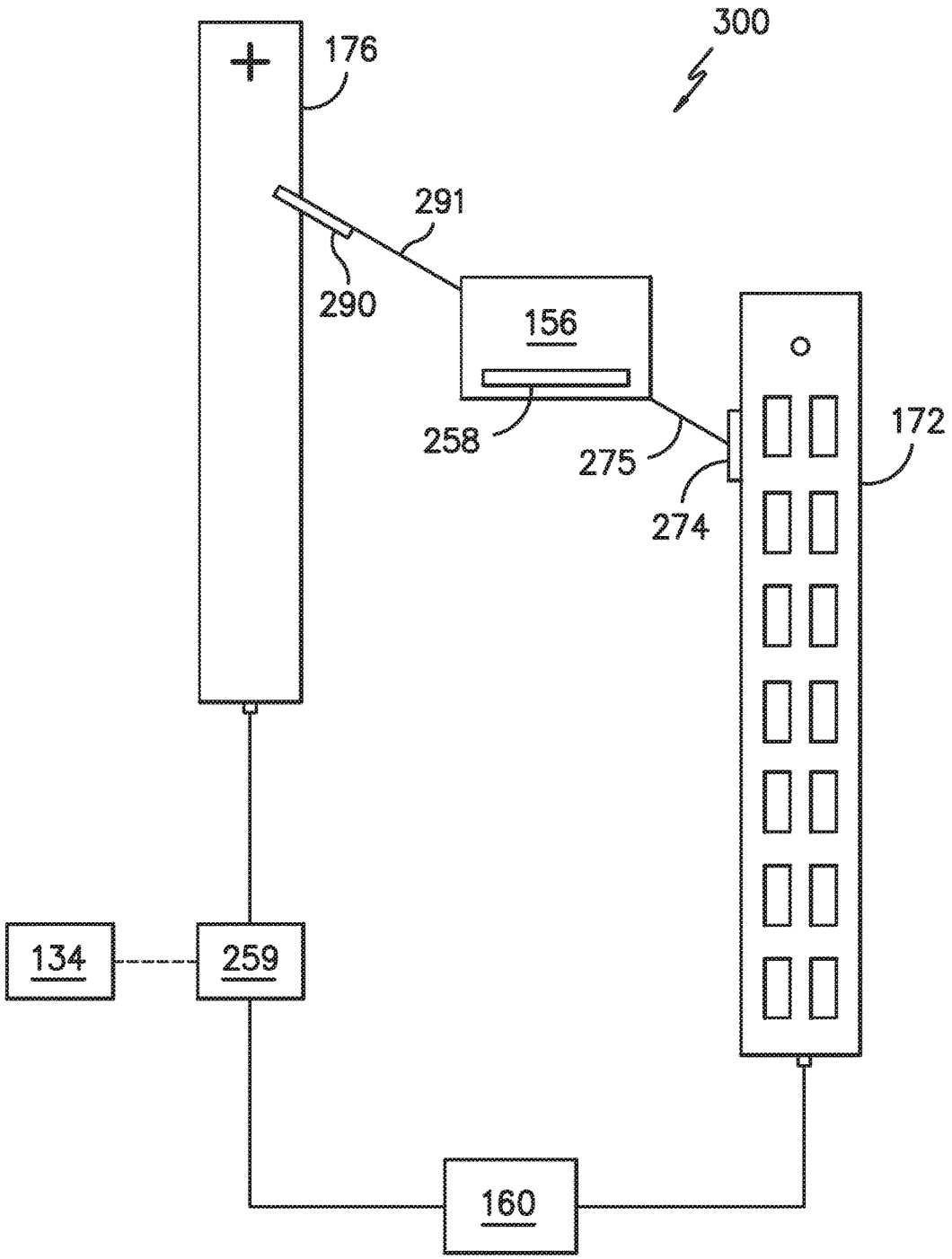
FIG. 11 provides a schematic diagram of a constant voltage circuit according to an exemplary embodiment of the present subject matter.

Referring now to FIGS. 10 and 11, FIG. 10 provides a schematic top plan view of powered track 150 for use with a constant voltage circuit 300 and FIG. 11 provides a perspective, schematic diagram of constant voltage circuit 300 according to an exemplary embodiment of the present subject matter. Constant voltage circuit 300 provides one exemplary method of powering adjustable shelves 156 with powered track 150. As shown in FIG. 10, first bus bar 172 is a cathode contact (depicted by the negative sign) and second bus bar 176 is an anode contact (depicted by the positive sign). However, in other exemplary embodiments, first bus bar 172 is an anode contact and second bus bar 176 is a cathode contact. In FIG. 10, the components of powered track 150 are spread from one another for illustrative purposes.

As shown in FIG. 11, first bus bar 172 and second bus bar 176 are positioned in constant voltage circuit 300 in electrical communication with power source 160, which is a constant voltage power supply in this embodiment. Controller 134 can be in operative communication with power source 160, load 258, and/or a load controller 259 to control the settings of load 258. For example, load 258 could be LED lighting and load controller 259 could be an LED dimmer transceiver for dimming the lighting of the LEDs according to a user's preferences. When first and second electrical connectors 274, 290 of exemplary adjustable shelf 156 are in electrical communication with first and second bus bars 172, 176 via first and second electrical wires 275, 291, the circuit is completed and power is delivered to load 258 of adjustable shelf 156. No matter the number of adjustable shelves 156 mounted to powered track 150 in constant voltage circuit 300, the voltage across the first and second bus bars 272, 274 will remain constant and the current will be varied to power loads 258 accordingly. It will be appreciated that other electrical components, such as resistors, transistors, switches, and the like could also be included in constant voltage circuit 300.

Figure 12:
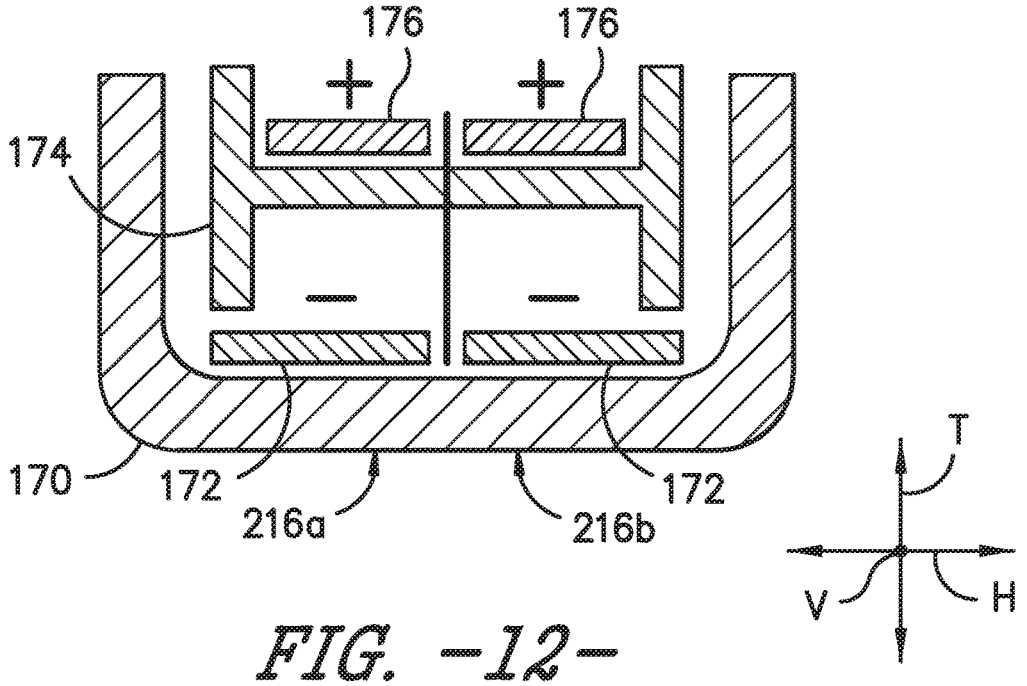
FIG. 12 provides a top plan view of a power track for use with a constant current circuit according to an exemplary embodiment of the present subject matter.
Figure 13:
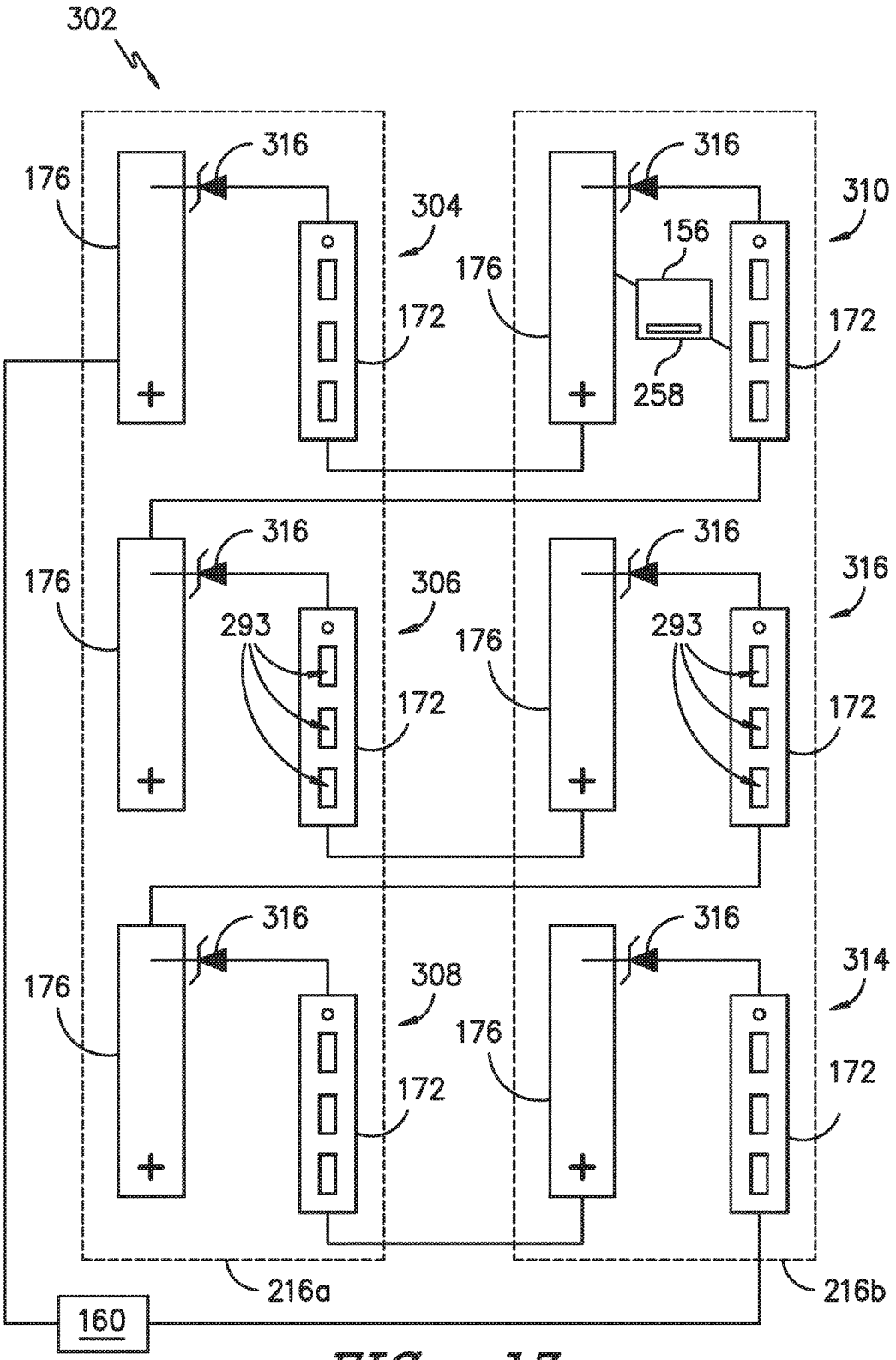
FIG. 13 provides a schematic diagram of a constant current circuit according to an exemplary embodiment of the present subject matter.

Referring now to FIGS. 12 and 13, FIG. 12 provides a schematic top plan view of powered track 150 for use with a constant current circuit 302 and FIG. 13 provides a schematic diagram of constant current circuit 302 according to exemplary embodiments of the present subject matter. Constant current circuit 302 provides another exemplary method of powering adjustable shelves 156 with powered track 150. As shown, each column 216 of mounting openings 293 includes first bus bar 172 and second bus bar 176. In other words, there is a designated first bus bar 172 and second bus bar 174 for each column 216 of powered track 150. The first bus bars 172 are cathode contacts (depicted by the negative signs) and second bus bars 176 are anode contacts (depicted by the positive signs). However, in other exemplary embodiments, first bus bars 172 are anode contacts and second bus bars 176 are cathode contacts.

As shown in FIG. 13, constant current circuit 302 includes a plurality of first bus bars 172 and second bus bars 174 connected in series. For first column 216*a*, first and second bus bars 172, 174 can be segmented into a top, middle, and bottom section 304, 306, 308. Likewise, second column 216*b* has first and second bus bars 172, 174 segmented into top, middle, and bottom sections 310, 312, 314. In this example, first bus bars 172 of each section 304, 306, 308 of first column 216*a* and second bus bars 174 of each section 310, 312, 314 have three mounting openings 293 for receiving adjustable shelf 156 for mounting.

Power source 160 is connected in series with second bus bar 176 of top section 304 of first column 216*a*. In this embodiment, power source is a constant current power supply or driver. From there, as there is no adjustable shelf 156 present (i.e., no load 258), the current passes to first bus bar 172 of top section 304 of first column 216*a*. More specifically, current passes through a zener diode 316. When the voltage across zener diode 316 has reached its zener voltage, or predetermined breakdown voltage, current passes through zener diode 316 to first bus bar 172 of top section 304 of first column 216*a*. If adjustable shelf 156 is positioned in a shelf mounting position in top section 304 of first column 216*a*, then current will pass through the load 258 of adjustable shelf 156, as the predetermined breakdown voltage of zener diode 316 will not be reached.

First bus bar 172 of top section 310 of first column 216*a* is connected in series with second bus bar 176 of top section 310 of second column 216*b*. Adjustable shelf 156 is positioned in a shelf mounting position in top section 310 of second column 216*b*. Thus, current will pass through load 258 of adjustable shelf 156 and to first bus bar 172 of top section 310 of the second column 216*b* as shown. Current will not pass through zener diode 316 of top section 310 of second column 216*b* when shelf 156 is mounted in this column and section to powered track 150, as current will pass through the path of least resistance, which is the load 258 in this embodiment.

If no adjustable shelf 156 was present in top section 310 of second column 216*b*, then current would pass through zener diode 316 positioned between second bus bar 176 and first bus bar 172 of top section 310 of second column 216*b* to allow for current to flow to the remaining sections of powered track 150. More specifically, current would pass through zener diode 316 of top section of second column 216*b* when the predetermined breakdown voltage of zener diode 316 is reached.

The flow of current through constant current circuit 302 continues from first bus bar 172 of top section 310 of second column 216*b* to middle section 312 and then onward to bottom section 314 in the same manner as described above for top section 310. That is, if no adjustable shelf 156 is present, current will pass through zener diode 316, and if a shelf is present, current will pass through load 258 positioned on or integral with shelf 156. After exiting the first bus bar 172 of bottom section 314 of second column 216*b*, the current flows to power source 160 as shown. It will be appreciated that other electrical components, such as resistors, transistors, switches, and the like could also be included in constant current circuit 302.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a volume;

a powered track disposed within the cabinet for providing a plurality of shelf mounting positions and configured in electrical communication with a power source, the powered track extending between a top portion and a bottom portion, the powered track comprising:

a first support member defining a plurality of openings;

a first bus bar coupled with the first support member and defining a plurality of openings each in alignment with a corresponding one of the plurality of openings of the first support member, the first bus bar extending between the top portion and the bottom portion of the powered track;

a second support member coupled with the first support member; and a second bus bar spaced from the first bus bar and coupled with the second support member, the second bus bar extending between the top portion and the bottom portion of the powered track; and an adjustable shelf having at least one bracket attached to or formed integrally with the adjustable shelf for mounting the adjustable shelf to the powered track in one of the shelf mounting positions, the at least one bracket comprising:

a body extending between a first end and a second end;

a first tab extending from the second end of the body and having a first electrical connector, wherein when the adjustable shelf is mounted to the powered track at any one of the shelf mounting positions, the first electrical connector is in electrical communication with the first bus bar; and a second tab extending from the second end of the body and having a second electrical connector, wherein when the adjustable shelf is mounted to the powered track at any one of the shelf mounting positions, the second electrical connector is in electrical communication with the second bus bar.

2. The refrigerator appliance of claim 1, wherein the first tab includes a hook for securing the adjustable shelf to the powered track, and wherein the first electrical connector is positioned on the hook.

3. The refrigerator appliance of claim 2, wherein the cabinet defines a vertical direction, and wherein the hook comprises a vertical face oriented substantially along the vertical direction, and wherein the first electrical connector is positioned on the vertical face of the hook such that when the adjustable shelf is mounted to the powered track, the first electrical connector is biased against the first bus bar.

4. The refrigerator appliance of claim 1, wherein the first bus bar comprises a front surface and a rear surface, the front surface positioned flush with the first support member, and wherein the first electrical connector of the at least one bracket is positioned on a hook, and wherein when the adjustable shelf is mounted to the powered track at one of the shelf mounting positions, the first electrical connector is in electrical communication with the rear surface of the first bus bar.

5. The refrigerator appliance of claim 1, wherein the powered track defines the plurality of openings of the first support member and the plurality of openings of the first bus bar, together, defining a plurality of mounting openings for receiving the adjustable shelf, and wherein the first support member comprises a forward surface and the second bus bar comprises a forward surface, and wherein a depth of at least one of the mounting openings extends between the forward surface of the first support member and the forward surface of the second bus bar, and wherein, when the adjustable shelf is mounted to the powered track, the bracket extends into the at least one mounting opening a distance greater than the depth in such a way that the second electrical contact deflects the second bus bar, biasing the second bus bar against the second electrical contact.

6. The refrigerator appliance of claim 1, wherein the cabinet defines a vertical direction, a horizontal direction, and a transverse direction, the cabinet further defining a vertical centerline along the horizontal direction, and wherein the powered track is oriented substantially along the vertical centerline of the cabinet.

7. The refrigerator appliance of claim 1, wherein the refrigerator appliance defines a vertical direction and a horizontal direction and wherein the plurality of openings of the first support member and the first bus bar are oriented in two or more columns in the vertical direction and one or more rows in the horizontal direction.

8. The refrigerator appliance of claim 1, wherein the powered track is powered by a constant voltage source.

9. The refrigerator appliance of claim 1, wherein the powered track is powered by a constant current source.

10. The refrigerator appliance of claim 1, wherein the adjustable shelf comprises a light source in electrical communication with the first and second electrical connectors for delivering power to the light source, wherein the light source is in electrical communication with the first and second electrical connectors by a wired connection.

11. The refrigerator appliance of claim 1, wherein the at least one bracket attached to or formed integrally with the adjustable shelf supports at least a part of the adjustable shelf by cantilever.

12. A refrigerator appliance defining a vertical direction, a horizontal direction, and a transverse direction, comprising:

a cabinet defining a volume;

a powered track disposed within the cabinet and configured to be in electrical communication with a power source, the powered track extending between a top portion and a bottom portion, the powered track comprising:

a first support member defining a plurality of openings;

a first bus bar coupled with the first support member and defining a plurality of openings each in alignment with a corresponding one of the plurality of openings of the first support member, the first bus bar extending between the top portion and the bottom portion of the powered track; and a second bus bar spaced from the first bus bar, the second bus bar extending between the top portion and the bottom portion of the powered track; and an adjustable shelf extending between a first end and a second end, the second end having a first electrical connector and a second electrical connector located thereon or integral with the second end; and wherein, when the adjustable shelf is mounted to the powered track, the first electrical connector is in electrical communication with the first bus bar and the second electrical connector is in electrical communication with the second bus bar.

13. The refrigerator appliance of claim 12, wherein the adjustable shelf comprises at least one bracket attached to or formed integrally with the adjustable shelf, the bracket extending along the transverse direction between a first end and a second end and having a mounting hook located at the second end of the bracket for securing the adjustable shelf to the powered track, and wherein the first electrical connector is positioned on the hook.

14. The refrigerator appliance of claim 13, wherein the hook comprises a vertical face oriented along the vertical direction, and wherein the first electrical connector is positioned on the vertical face of the hook such that when the hook is inserted through one of the openings in the first support member and the first bus bar, the first electrical connector is biased in contact with the first bus bar.

15. The refrigerator appliance of claim 12, wherein the powered track defines the plurality of openings of the first support member and the plurality of openings of the first bus bar, together, as a plurality of mounting openings, and wherein the first support member comprises a forward surface and the second bus bar comprises a forward surface, and wherein a depth of the mounting opening extends between the forward surface of the first support member and the forward surface of the second bus bar, and wherein, when the adjustable shelf is mounted to the powered track, the bracket and the second electrical contact extend into the mounting opening a distance greater than the depth in such a way that the second electrical contact deflects the second bus bar, thereby biasing the second bus bar against the second electrical contact.

16. The refrigerator appliance of claim 12, wherein the second bus bar is spaced from the first bus bar in the transverse direction by a second support member.

17. A refrigerator appliance defining a vertical direction, a horizontal direction, and a transverse direction, the refrigeration appliance extending in the transverse direction between a front end and a rear end, the refrigerator appliance comprising:

a cabinet defining a volume;

a powered track mounted to a rear wall of the cabinet and configured to be in electrical communication with a power source, the powered track comprising:

a first support member defining a plurality of openings arranged in a first column and a second column;

a first, left bus bar coupled with the first support member and defining a plurality of openings each in alignment with a corresponding one of the plurality of openings arranged in the first column of the first support member, the first, left bus bar positioned rearward of the first support member along the transverse direction;

a first, right bus bar coupled with the first support member and defining a plurality of openings each in alignment with a corresponding one of the plurality of openings arranged in the second column of the first support member, the first, right bus bar positioned rearward of the first support member along the transverse direction and spaced from the first, left bus bar along the horizontal direction;

a second support member coupled with the first support member; and a second, left bus bar positioned rearward of and spaced from the first, left bus bar along the transverse direction, the second, left bus bar coupled with the second support member;

a second, right bus bar positioned rearward of and spaced from the first, right bus bar along the transverse direction, the second, right bus bar spaced from the second, left bus bar along the horizontal direction, the second, right bus bar coupled with the second support member; and an adjustable shelf having a bracket attached to or formed integrally with the adjustable shelf for mounting the adjustable shelf to the powered track, the bracket comprising:

a body extending between a first end and a second end;

a first tab extending from the second end of the body and having a first electrical connector, wherein when the adjustable shelf is mounted to the powered track, the first electrical connector is in electrical communication with the first, left bus bar or the first, right bus bar; and a second tab extending from the second end of the body and having a second electrical connector, wherein when the adjustable shelf is mounted to the powered track, the second electrical connector is in electrical communication with the second, left bus bar or the second, right bus bar.

18. The refrigerator appliance of claim 17, wherein the second support member comprises:

a pair of opposed transverse members extending along the transverse direction between a front portion and a rear portion and along the vertical direction between a top portion and a bottom portion, wherein a gap is defined between the opposed transverse members;

a plurality of horizontal members, at least one of the plurality of horizontal members extending between the opposed transverse members proximate the top portion and at least one of the plurality of horizontal members extending between the opposed transverse members proximate the bottom portion; and a plurality of retention members, at least one of the retention members extending between the opposed transverse members proximate the top portion and rearward of the horizontal member extending between the opposed transverse members proximate the top portion along the transverse direction and at least one of the retention members extending between the opposed transverse members proximate the bottom portion and rearward of the horizontal member extending between the opposed transverse members proximate the bottom portion along the transverse direction, wherein a slit is defined between the horizontal member and the retention member extending between the opposed transverse members proximate the top portion and wherein a slit is defined between the horizontal member and the retention member extending between the opposed transverse members proximate the bottom portion;

wherein the second, left bus bar and the second, right bus are disposed within the slits such that the second, left bus bar and the second, right bus bar are coupled with the second support member.

19. The refrigerator appliance of claim 17, wherein the first, right bus bar is electrically connected in series with the second, right bus bar, the second, right bus bar is electrically connected in series with the first, left bus bar, and the first, left bus bar is electrically connected in series with the second, left bus bar.

* * * * *